US009428702B2

(12) United States Patent
Sprouse et al.

(10) Patent No.: US 9,428,702 B2
(45) Date of Patent: Aug. 30, 2016

(54) AGGLOMERATOR WITH CERAMIC MATRIX COMPOSITE OBSTACLES

(75) Inventors: Kenneth M. Sprouse, Northridge, CA (US); David R. Matthews, Simi Valley, CA (US)

(73) Assignee: Gas Technology Institute, Des Plaines, IL (US)

( * ) Notice: Subject to any disclaimer, the term of this patent is extended or adjusted under 35 U.S.C. 154(b) by 1064 days.

(21) Appl. No.: 13/180,755

(22) Filed: Jul. 12, 2011

(65) Prior Publication Data

US 2013/0014439 A1 Jan. 17, 2013

(51) Int. Cl.

| | |
|---|---|
| ***C10J 3/84*** | (2006.01) |
| ***C10J 3/00*** | (2006.01) |
| ***C10J 3/74*** | (2006.01) |
| ***C10J 3/76*** | (2006.01) |
| ***C10K 1/02*** | (2006.01) |

(52) U.S. Cl.

CPC .. *C10J 3/84* (2013.01); *C10J 3/00* (2013.01); *C10J 3/74* (2013.01); *C10J 3/76* (2013.01); *C10K 1/022* (2013.01); *C10K 1/026* (2013.01); *C10J 2300/1884* (2013.01); *C10J 2300/1892* (2013.01)

(58) Field of Classification Search

CPC ..... C10J 3/84; C10J 2300/1625
USPC ..... 48/61
See application file for complete search history.

(56) References Cited

U.S. PATENT DOCUMENTS

| | | | | |
|---|---|---|---|---|
| 4,326,856 | A * | 4/1982 | Muenger et al. | 48/197 R |
| 4,368,103 | A | 1/1983 | Weinzierl et al. | |
| 4,441,892 | A | 4/1984 | Shuster | |
| 4,488,512 | A * | 12/1984 | Boyle | B01J 3/02 110/101 CD |
| 4,597,771 | A | 7/1986 | Cheng | |
| 4,969,931 | A | 11/1990 | Wu et al. | |
| 5,250,090 | A | 10/1993 | Vandervort et al. | |
| 6,027,540 | A | 2/2000 | Smith et al. | |
| 6,920,836 | B2 | 7/2005 | Sprouse | |
| 2005/0257753 | A1 * | 11/2005 | Franke | F22B 1/1815 122/406.4 |
| 2006/0210457 | A1 * | 9/2006 | Sprouse et al. | 422/198 |
| 2008/0041572 | A1 * | 2/2008 | Wessel et al. | 165/157 |

OTHER PUBLICATIONS

The International Search Report and Written Opinion of counterpart International Application No. PCT/US2012/046397 filed Jul. 12, 2012.

* cited by examiner

*Primary Examiner* — Matthew Merkling
(74) *Attorney, Agent, or Firm* — Pauley Erickson & Kottis

(57) ABSTRACT

A slag agglomerator includes an inlet, an outlet and a plurality of obstacles. The inlet receives a flow of gas and slag droplets and the outlet allows the flow of gas and slag droplets to exit the agglomerator. The obstacles are oblique or perpendicular to the flow of gas and slag droplets and have an exterior surface containing a ceramic matrix composite.

21 Claims, 3 Drawing Sheets

AGGLOMERATOR WITH CERAMIC MATRIX COMPOSITE OBSTACLES

BACKGROUND

Gasification is one method for extracting energy from organic materials. Gasification is a process that converts carbonaceous materials, such as coal, petroleum, biofuel or biomass, into carbon monoxide and hydrogen by reacting a raw material at high temperature with a controlled amount of oxygen and/or steam. The resulting gas mixture is called syngas.

One of the byproducts of gasification is ash (e.g., fly ash). Ash is one of the residues generated during the combustion of char in a gasifier. Fly ash includes the fine particles that rise with flue gases. Ash which does not rise is termed bottom ash. Ash material must be removed from the syngas before it can be used as a fuel. Gasification systems typically use one or more separation methods to remove ash from syngas.

Cyclone separators (cyclones) are used to remove particulates from an air, gas or liquid stream, without the use of filters, through vortex separation. Cyclones can be used to remove some of the ash material from the syngas. However, ash particles having particle diameters less than about 10 μm are not easily removed from a gas stream using cyclones. Due to the small particle size of the ash, the ash is not easily separated from the gas stream and much of the ash exits the cyclone with the gas stream. In gasification systems producing ash particles with diameters less than about 10 μm, additional separation steps are needed.

These gasification systems often employ candle filters. Candle filters are often metallic or ceramic, and each has drawbacks. Metallic candle filters are vulnerable to acid gas corrosion. Sulfur and alkali metal oxy-hydroxides within the syngas stream can form acid gas, which corrodes metal candle filters leading to reduced filter life and frequent filter replacement. Ceramic candle filters are fragile and also susceptible to corrosion. Ceramic candle filters are subjected to high temperatures during separation. These high temperatures can lead to cracks in the ceramic candle filter. Constituents of the syngas stream can also corrode or oxidize the ceramics. Both metal and ceramic candle filters are also vulnerable to inter-pore plugging and failure when the ash particles are submicron (diameters less than 1 μm). Additionally, metal and ceramic candle filters are large and expensive to install, operate and maintain.

DETAILED DESCRIPTION

The slag agglomerator described herein has ceramic matrix composite obstacles (agglomeration cylinders or tubes). The slag agglomerator groups small slag droplets present in the syngas together to facilitate downstream slag removal that does not require candle filters. The small slag droplets impinge on the obstacles, ultimately forming larger slag particles that can be separated from the gas stream using a cyclone.

Figure 1:
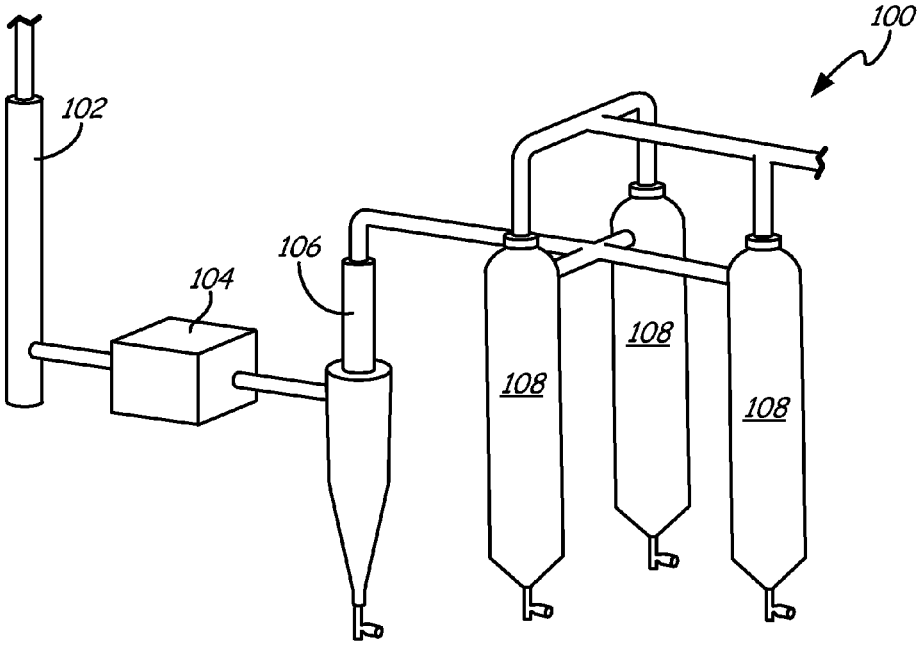
Fig. 1 PRIOR ART
FIG. 1 is a simplified schematic of a prior art gasification system having cyclones and candle filters.

FIG. 1 illustrates a portion of a typical gasification system that produces fly ash with small particle diameters. Gasification system 100 includes gasifier 102, quench station 104, cyclone 106 and candle filters 108. During operation of gasification system 100, a hot gas stream exits gasifier 102. The hot gas stream includes syngas. Fly ash is also carried by the gas stream. The gas stream exits gasifier 102 at a temperature of about 1370° C. (2500° F.). The gas stream enters quench station 104 and is cooled to about 370° C. (700° F.). The cooled gas stream then enters cyclone 106 where fly ash is separated from the gas stream by vortex separation. In gasification systems that produce fly ash having small particle diameters (less than about 10 μm), cyclone 106 is unable to remove sufficient amounts of fly ash from the gas stream. In these cases, candle filters 108 are required to complete the separation of fly ash from the gas stream. The gas stream exits cyclone 106 and is passed through one or more candle filters 108 to remove sufficient quantities of fly ash from the gas stream. Upstream quench station 104 must cool the gas stream to a relatively low temperature to prevent damage to candle filters 108.

As noted above, candle filters 108 are susceptible to corrosion, can be fragile, possess a large footprint and require significant installation, operation and maintenance costs. Eliminating candle filters from gasification systems can decrease system cost and increase overall system efficiency. Simply removing candle filters is not an option for gasification systems that produce small particle fly ash, however. The slag agglomerator described herein employs ceramic matrix composite obstacles to increase the particle size of slag (molten fly ash) so that cyclone separation is sufficient to remove fly ash from the gas stream.

Figure 2:
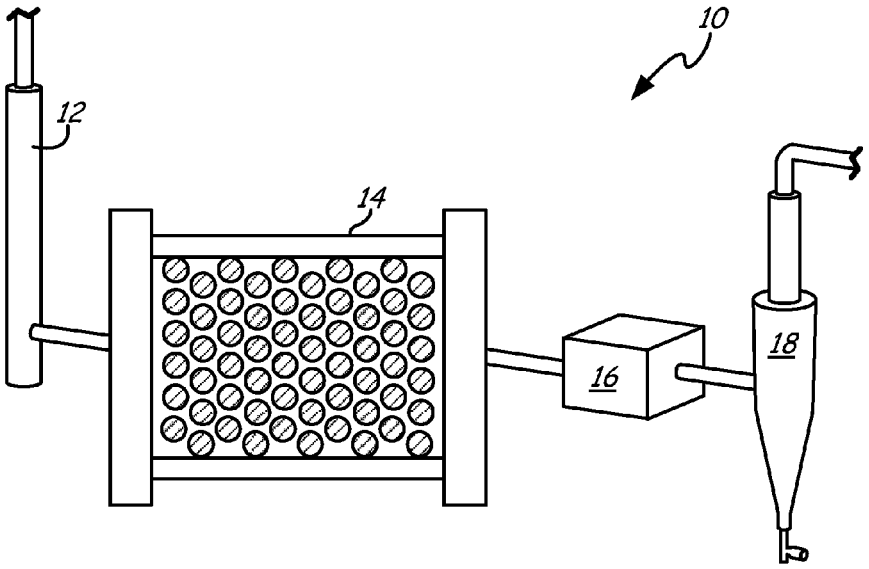
FIG. 2 is a simplified schematic of a gasification system having a slag agglomerator.

FIG. 2 illustrates a gasification system with a slag agglomerator. Gasification system 10 includes gasifier 12, slag agglomerator 14, quench station 16 and cyclone 18. A gas stream containing syngas and fly ash is produced in gasifier 12. In some cases, gasifier 12 produces fly ash having particle diameters less than about 10 μm. Gasifier 12 can also produce fly ash having submicron (less than 1 μm) particle diameters. In order for fly ash particles of this size to be removed from the gas stream using only a cyclone (i.e. no candle filters), the particle size of the fly ash must be increased before the particles reach cyclone 18. Slag agglomerator 14 increases the particle size of the fly ash.

Figure 3:
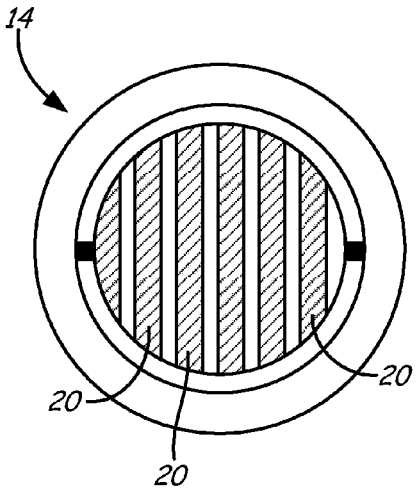
FIG. 3 illustrates a cross-section of the inlet of a slag agglomerator.
Figure 4:
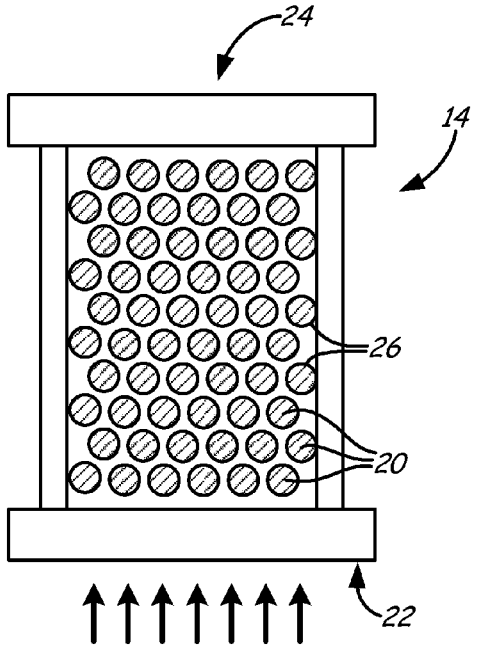
FIG. 4 illustrates a horizontal cross-section of the slag agglomerator of FIG. 3.

At high temperature, fly ash particles melt and form liquid slag droplets. Slag agglomerator 14 increases the particle size of the slag droplets by causing them to agglomerate and grow in size. FIGS. 3 and 4 illustrate cross-sections of one embodiment of slag agglomerator 14. FIG. 3 illustrates a cross-section of the inlet of slag agglomerator 14 while FIG. 4 illustrates a horizontal cross-section of slag agglomerator 14. In one embodiment of gasification system 10, the gas stream from gasifier 12 arrives at slag agglomerator 14 having a temperature between about 1260° C. (2300° F.) and about 1480° C. (2700° F.). Within this temperature range, fly ash particles form slag droplets.

Slag agglomerator 14 contains a plurality of obstacles 20 (agglomeration cylinders or tubes) and includes inlet 22 and outlet 24. Obstacles 20 are positioned oblique or perpendicular to the flow of the gas stream. As shown in FIG. 3, obstacles are positioned vertically in exemplary embodiments. As the gas stream flows through slag agglomerator 14, slag droplets present in the gas stream impinge upon and adhere to obstacles 20. Obstacles 20 are arranged within slag agglomerator 14 so that substantially all slag droplets above 0.1 μm in diameter and below 10 μm in diameter impinge upon at least one obstacle 20 before reaching outlet 24. Obstacles 20 can be arranged within slag agglomerator 14 in rows as shown in FIG. 4. As the gas stream flows through slag agglomerator 14, the presence of obstacles 20 forces the gas stream to take a tortuous path through slag agglomerator 14. Due to the gas stream velocity and curvatures, slag droplets within the gas stream impinge on obstacles 20. The dimensions, number, number of rows and placement of obstacles 20, are determined for slag agglomerator 14 depending on the characteristics of gasification system 10. A detailed particle impact analysis is performed to determine the appropriate layout of obstacles 20. Factors considered in such an analysis include the gas stream velocity, fly ash/slag particle size, obstacle dimensions and pressure drop, among others.

Obstacles 20 have exterior surfaces 26 containing a ceramic matrix composite (CMC). As described in further detail below, obstacles 20 are actively cooled to solidify a portion of the slag droplets that impinge on obstacles 20. These frozen slag droplets will stick to the CMC forming a protective coating that prevents detrimental CMC corrosion and erosion. The heat flux through cooled obstacles 20 is maintained so that most of the slag droplets striking obstacles 20 remain molten and either flow down obstacles 20 to be removed from the bottom of slag agglomerator 14 or are re-entrained into the gas flow from the downstream side of obstacles 20 having larger drop sizes. Ceramic matrix composites can tolerate significant tensile stress and thermal shocks without cracking or breaking, making them resistant to the temperatures and forces of the gas stream and slag droplets flowing through slag agglomerator 14. Ceramic matrix composites can provide much more strength than monolithic ceramic materials. Ceramic matrix composites constitute ceramic fibers embedded in a ceramic matrix. The CMC of obstacles 20 includes a matrix component and reinforcing fibers. In one exemplary embodiment, the matrix component of obstacles 20 is silicon carbide (SiC). Silicon carbide has high thermal conductivity properties. Additionally, silicon carbide present on exterior surfaces 26 of obstacles 20 chemically reacts with molten slag droplets. The molten slag droplets react with silicon carbide to form frozen iron silicide ($Fe_3Si$). As slag droplets impinge on exterior surface 26 of obstacle 20, the formed iron silicide produces a bonding layer on exterior surface 26. This bonding layer allows additional slag droplets to solidify and adhere to exterior surface 26 of obstacle 20. The bonding layer eventually covers the upstream side of exterior surface 26, providing additional protection to obstacle 20. In alternative embodiments, the matrix component of obstacles 20 is selected from alumina, silica, chromia, mullite and combinations thereof.

The reinforcing fibers of the CMC used in obstacles 20 provide support to the matrix component. Suitable materials for the reinforcing fibers include carbon, silicon carbide, alumina, mullite and combinations thereof. Silicon carbide fibers include those sold under the trade name Nicalon™ (Nippon Carbon Company). Alumina fibers include those sold under the trade name Nextel 610™ (3M). Mullite fibers include those sold under the trade name Nextel 720™ (3M). Ceramic matrix composites made from the combinations of matrix components and reinforcing fibers described above offer good resistance to thermal shock.

Obstacles 20 are actively cooled so that a portion of the slag droplets that impinges on exterior surfaces 26 of obstacles 20 solidify. As noted above, the gas stream entering slag agglomerator 14 can have a temperature between about 1260° C. (2300° F.) and about 1480° C. (2700° F.). At this temperature, the fly ash present in the gas stream is in a liquid state and forms slag droplets. As a slag droplet impinges on exterior surface 26, heat is transferred from the slag droplet to exterior surface 26, thereby reducing the temperature of the slag droplet. By reducing the temperature of the slag droplet, the droplet transitions from the liquid phase to the solid phase and solidifies on exterior surface 26. Obstacles 20 are cooled to a temperature that causes slag droplets impinging on exterior surface 26 to solidify. In exemplary embodiments, obstacles 20 are cooled so that exterior surfaces 26 have a temperature between about 760° C. (1400° F.) and about 925° C. (1700° F.). This temperature range is below the slag solidus temperature, which is between about 1090° C. (2000° F.) and about 1260° C. (2300° F.). In one embodiment of gasification system 10, obstacles 20 are water cooled. Water used to cool obstacles 20 can be liquid water, steam, superheated steam and combinations thereof. Other coolants such as gaseous nitrogen, argon, carbon dioxide and their combinations can also be used.

As the solid slag coating is formed over obstacles 20, steady-state conditions are reached whereby the heat transferred to the coolant of obstacles 20 is equal to the convective heat transferred to obstacles 20 from the gas stream. At this steady-state condition, no additional freezing of the slag droplets occurs when they impact obstacles 20. Instead, the slag droplets either flow down obstacles 20 to be collected and drained from the bottom of slag agglomerator 14 or the slag droplets are re-entrained into the gas stream from the back-side of obstacles 20 as a droplet with a significantly increased diameter.

Figure 5:
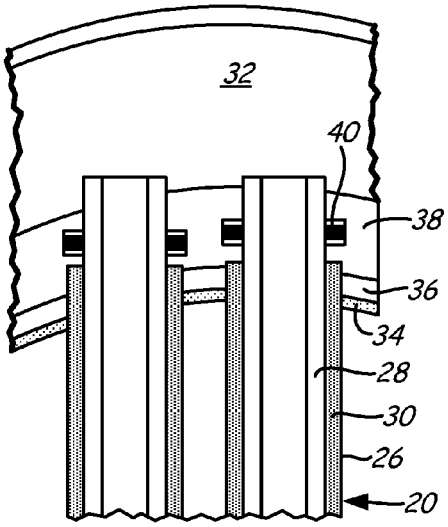
FIG. 5 illustrates a cross-section through one embodiment of an agglomerator cylinder (obstacle).

FIG. 5 illustrates one embodiment of obstacle cooling. Disposed within obstacle 20 is coolant tube 28. Coolant tube 28 is located inside and surrounded by the CMC material that makes up CMC shell 30. Coolant tube 28 extends the length of obstacle 20 connecting each longitudinal end of obstacle 20 to a coolant manifold. One such manifold, coolant manifold 32 is illustrated in FIG. 5. Ceramic matrix composite liner 34, metal containment shell 36 and coolant tube closeout ring 38 separate coolant manifold 32 from the portion of slag agglomerator 14 that contains the hot gas stream and agglomerator cylinders 20. Ring seal 40 prevents coolant from entering the portion of slag agglomerator 14 that contains the hot gas stream and prevents the hot gas stream from entering coolant manifold 32.

In exemplary embodiments, coolant tube 28 is metal, such as stainless steel. A coolant (cooling water, steam, etc.) is delivered from coolant manifold 32 to coolant tube 28 to cool obstacle 20 so that CMC shell 30 and exterior surface 26 is cool enough to cause a fraction of the impinging slag droplets to solidify on exterior surface 26. In exemplary embodiments, the coolant delivered to coolant tubes 28 has a temperature between about 315° C. (600° F.) and about 425° C. (800° F.). The heat absorbed by the coolant in coolant tube 28 can be recovered and used for other purposes (e.g., drive steam turbines, reuse as steam in gasification process).

Figure 6:
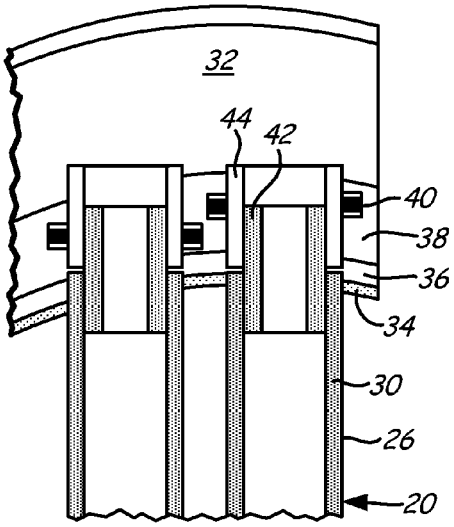
FIG. 6 illustrates a cross-section through another embodiment of an agglomerator cylinder (obstacle).

FIG. 6 illustrates another embodiment of obstacle cooling. Instead of having coolant tube 28 disposed within obstacle 20, the coolant directly cools the CMC material of CMC shell 30. Coupling (nipple) 42 connects obstacle 20 to metal tube 44. Metal tube 44 extends from coolant manifold 32.

Ceramic matrix composite liner 34, metal containment shell 36 and coolant tube closeout ring 38 separate coolant manifold 32 from the portion of slag agglomerator 14 that contains the hot gas stream and agglomerator cylinders 20. Ring seal 40 prevents coolant from entering the portion of slag agglomerator 14 that contains the hot gas stream and prevents the hot gas stream from entering coolant manifold 32.

In exemplary embodiments, coupling 42 is constructed of silicon nitride. This embodiment provides increased thermal efficiency compared to the embodiment illustrated in FIG. 5. In exemplary embodiments, the coolant delivered to obstacles 20 has a temperature between about 315° C. (600° F.) and about 650° C. (1200° F.). The heat absorbed by the coolant traveling inside CMC shell 30 can be recovered and used for other purposes (e.g., drive steam turbines, reuse as steam in gasification process).

However, where a CMC having silicon carbide is used for CMC shell 30, the cooling water must be substantially free of oxygen and have a temperature lower than about 370° C. (700° F.). Oxygen present in the cooling water will react with silicon carbide present in CMC shell 30 to form silica ($SiO_2$). Water will further react with the silica to form silica oxy-hydroxides. These reactions corrode CMC shell 30 and will cause deterioration of obstacle 20. To avoid these reactions, the cooling water used must be substantially free of oxygen. In embodiments where superheated steam is used as the cooling water, the temperature of the superheated steam must be maintained below about 650° C. (1200° F.). Temperatures above this limit can cause the steam to dissociate into molecular hydrogen and molecular oxygen, resulting in the presence of oxygen within the cooling water and subsequent corrosion of obstacle 20.

Figure 7:
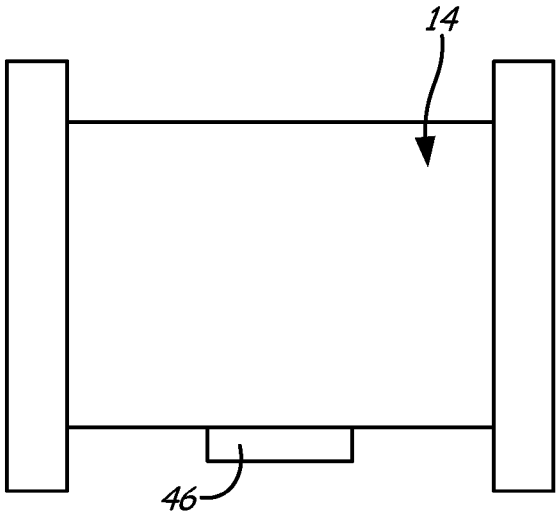
FIG. 7 illustrates a slag agglomerator having a slag outlet.

As slag droplets impinge on exterior surfaces 26 of obstacles 20, some of the slag droplets solidify and adhere to exterior surfaces 26. Additional gas and slag droplets from gasifier 12 are delivered to slag agglomerator 14, resulting in continued slag build up on obstacles 20 until a steady-state coating thickness of solid slag has been reached. Due to the velocity of the gas stream flow through slag agglomerator 14 and the impingement of additional slag droplets, the subsequent molten slag adhered to exterior surfaces 26 of obstacles 20 will eventually flow down exterior surfaces 26 of obstacles 20 or dislodge. The rate of slag dislodge is determined by gas stream velocity, surface tension and slag composition, temperature and viscosity. Typically, the dislodged slag will have a drop size larger than the slag droplets that entered slag agglomerator 14 in the gas stream. This larger drop of dislodged slag will be carried out of slag agglomerator 14 through outlet 24 by the gas stream. Molten slag that flows down exterior surfaces 26 of obstacles 20 to the bottom of slag agglomerator 14 are generally too large to be carried by the gas stream. In one embodiment of slag agglomerator 14, this molten slag will be removed through slag outlet 46 in a bottom portion of slag agglomerator 14 as shown in FIG. 7. Dislodged slag drops carried by the gas stream may impinge on additional downstream obstacles 20 and will either be carried to outlet 24 by subsequent re-entrainment in the gas stream or discharged from slag outlet 46. These dislodged slag drops will typically have drop sizes larger than 10 μm in diameter, allowing these drops to be subsequently cooled and separated from the gas stream in downstream cyclone 18.

Once the gas stream (with slag drops) leaves slag agglomerator 14, the gas stream is quenched at quench station 16. Quench station 16 cools the gas stream using cooling water or other heat exchange material so that syngas and slag particles in the gas stream can be further processed downstream of slag agglomerator 14. The heat absorbed by the cooling water in quench station 16 can be recovered and used for other purposes (e.g., drive steam turbines, reuse as steam in gasification process). Since candle filters are not used in gasification system 10, the gas stream does not need to be cooled as much. In gasification system 100, having candle filters 108, quench station 104 typically needs to cool the gas stream to a temperature below about 370° C. (700° F.). As no candle filters are used in gasification system 10, quench system 16 need only cool the gas stream to a temperature below about 925° C. (1700° F.), increasing the overall efficiency of gasification system 10. The hotter post-quench gas stream in gasification system 10 can also be passed through a heat exchanger to Cyclone 18 separates the slag particles from syngas in the gas stream. Because the slag droplets impinged on obstacles 20 and exited slag agglomerator 14 as slag having increased particle size, cyclone 18 can sufficiently separate the syngas and slag particles. One or more cyclones 18 can be employed for the separation. Cyclone 18 does not possess the installation, operation or maintenance costs associated with candle filters. Thus, the cost efficiency of gasification system 10 is improved relative to gasification system 100.

Figure 8:
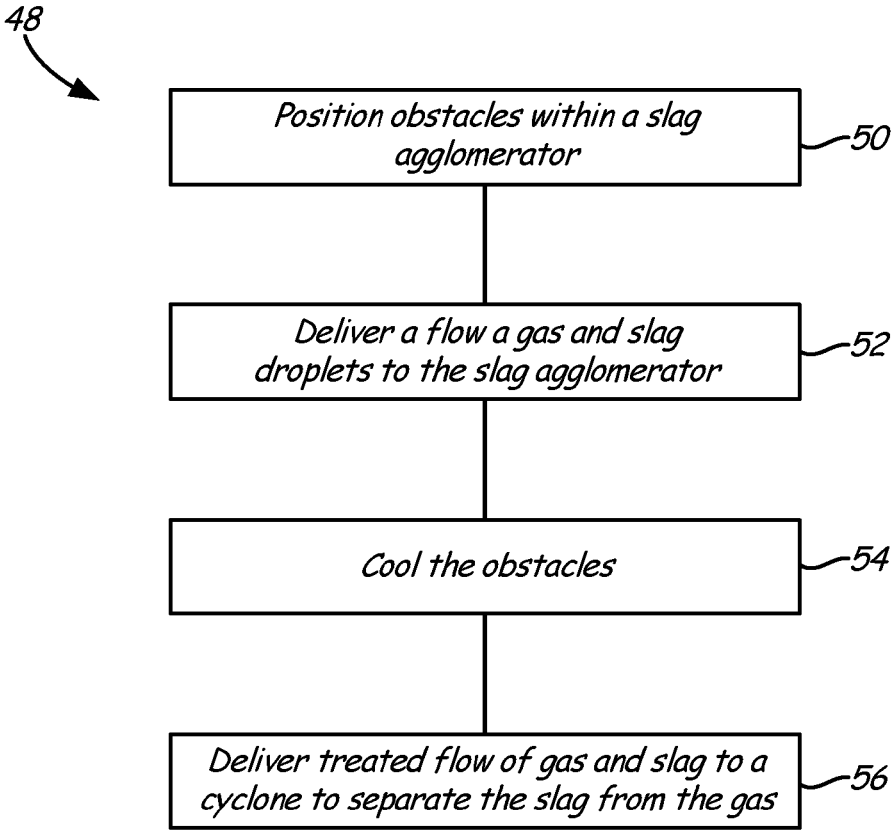
FIG. 8 is a simplified flow diagram of a method for removing slag from a gas.

FIG. 8 illustrates method 48 for removing fly ash (slag) from a gas using the above described slag agglomerator 14 and gasification system 10. In step 50, a plurality of obstacles are positioned within a slag agglomerator. Each obstacle has an exterior surface containing a CMC. In step 52, a flow of gas and slag droplets are delivered to the slag agglomerator. The gas and slag droplets are delivered so that substantially all slag droplets impinge on the exterior surface of at least one obstacle before exiting the slag agglomerator. In step 54, the obstacles are cooled with water so that slag droplets impinging on the exterior surfaces of the obstacles solidify on the exterior surfaces. In step 56, the flow of gas and slag that has passed through the slag agglomerator is delivered to a cyclone to separate the slag from the gas.

A slag agglomerator having ceramic matrix composite agglomeration tubes improves the overall efficiency of a gasification system that produces fly ash particles having small diameters. The slag agglomerator increases the particle size of slag droplets present in syngas to facilitate downstream slag removal that does not require candle filters. Small slag droplets impinge on obstacles within the slag agglomerator to form larger slag particles that can be separated from the gas stream using only a cyclone.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gasification system comprising:

a downflow gasifier;

a slag agglomerator having a gas flow path and a plurality of obstacles, wherein each obstacle has an exterior surface containing a ceramic matrix composite, wherein each obstacle has a coolant tube disposed within the obstacle, and wherein the obstacles are positioned within the agglomerator oblique to the gas flow path and in multiple offset rows so that the gas flow path is tortuous and substantially all slag droplets flowing through the slag agglomerator impinge upon at least one obstacle before exiting the slag agglomerator;

a cyclone for removing slag from a gas stream that has passed through the slag agglomerator.

2. A gasification system comprising:

a gasifier;

a slag agglomerator separate and spaced apart from the gasifier, the slag agglomerator having;

an inlet for receiving a flow of gas and slag droplets;

an outlet for allowing the flow of gas and slag droplets to exit the agglomerator;

a plurality of obstacles having an internal coolant flow, the plurality of obstacles positioned within the slag agglomerator oblique to the flow of gas and slag droplets and in multiple offset rows so that the gas flow path is tortuous, wherein the obstacles have an exterior surface containing a ceramic matrix composite, wherein the obstacles are positioned within the agglomerator so that substantially all slag droplets impinge upon at least one obstacle before reaching the outlet; and a cyclone for removing slag from a gas stream that has passed through the slag agglomerator.

3. The gasification system of claim 2, wherein the slag agglomerator further includes a cooling means for cooling the obstacles.

4. The gasification system of claim 2, wherein the slag agglomerator further includes obstacles having an exterior surface comprising a silicon carbide matrix.

5. The gasification system of claim 4, wherein the obstacles have an exterior surface containing fibers selected from the group consisting of carbon, silicon carbide, alumina, mullite and combinations thereof.

6. The gasification system of claim 4, wherein the exterior surface of the obstacles reacts with slag droplets to form iron silicide.

7. The gasification system of claim 2, wherein the obstacles have an exterior surface containing a matrix selected from the group consisting of alumina, silica, chromia, mullite and combinations thereof.

8. The gasification system of claim 3, wherein the cooling means cools the obstacles so that the exterior surfaces of the obstacles is at a temperature between about 760° C. (1400° F.) and about 925° C. (1700° F.).

9. The gasification system of claim 3, wherein each obstacle is connected to the cooling means by a stainless steel tube disposed inside the obstacle.

10. The gasification system of claim 3, wherein each obstacle is connected to the cooling means by a silicon nitride coupling.

11. The gasification system of claim 2, wherein the plurality of obstacles are arranged vertically.

12. The gasification system of claim 2, wherein the obstacles are positioned within the agglomerator so that substantially all slag droplets having a diameter less than about 10 .mu.m impinge upon at least one obstacle before reaching the outlet.

13. The gasification system of claim 2, further comprising: a slag outlet for removing for removing slag from a bottom portion of the slag agglomerator.

14. The gasification system of claim 2, wherein the gas to the slag agglomerator has a temperature between about 1260° C. (2300° F.) and about 1480° C. (2700° F.).

15. The gasification system of claim 1, wherein the gas to the slag agglomerator has a temperature between about 1260° C. (2300° F.) and about 1480° C. (2700° F.).

16. A gasification system comprising:

a gasifier to convert carbonaceous material to produce a gas stream containing fly ash;

a slag agglomerator spaced apart from the gasifier, the slag agglomerator to process the gas stream wherein slag droplets formed by the fly ash are agglomerated, the slag agglomerator having:

a gas flow path;

an inlet for receiving a flow of the gas stream;

an outlet for allowing a flow of gas and slag droplets to exit the agglomerator; and a plurality of obstacles having an internal coolant flow, the plurality of obstacles positioned within the slag agglomerator oblique to the gas flow path and in multiple offset rows so that the gas flow path is tortuous, wherein the obstacles have an exterior surface containing a ceramic matrix composite, wherein the obstacles are positioned within the agglomerator so that substantially all slag droplets impinge upon at least one obstacle before reaching the outlet; and a cyclone for removing slag from the gas stream that has passed through the slag agglomerator, wherein a conduit extending between the gasifier and the slag agglomerator inlet conveys the gas stream containing fly ash from the gasifier to the agglomerator.

17. The gasification system of claim 16, wherein the gas stream to the slag agglomerator has a temperature between about 1260° C. (2300° F.) and about 1480° C. (2700° F.).

18. The gasification system of claim 16, wherein the slag agglomerator further includes a cooling means for cooling the obstacles.

19. The gasification system of claim 18, wherein coolant within the coolant tubes cools the obstacles so that the exterior surfaces of the obstacles is at a temperature between about 760° C. (1400° F.) and about 925° C. (1700° F.).

20. The gasification system of claim 16, wherein the slag agglomerator further includes obstacles having an exterior surface comprising a silicon carbide matrix.

21. The gasification system of claim 16, wherein the obstacles have an exterior surface containing a matrix selected from the group consisting of alumina, silica, chromia, mullite and combinations thereof.

* * * * *